US005766523A

United States Patent [19]

Rodgers et al.

[11] Patent Number: 5,766,523

[45] Date of Patent: Jun. 16, 1998

[54] BLOW SPINNING DIE AND PROCESS FOR SPINNING CARBON FIBERS FROM SOLVATED PITCHES

[75] Inventors: John A. Rodgers, Ooltewah; Daniel F. Rossillon, Signal Mountain; Roger A. Ross, Chattanooga, all of Tenn.

[73] Assignee: Conoco Inc., Ponca City, Okla.

[21] Appl. No.: 791,443

[22] Filed: Jan. 27, 1997

Related U.S. Application Data

[62] Division of Ser. No. 478,318, Jun. 7, 1995, abandoned.

[51] Int. Cl.[6] ..... D01F 9/12; D02G 3/02

[52] U.S. Cl. ..... 264/29.2; 264/169; 264/210.8; 264/211.11; 264/555; 425/72.2; 425/198; 425/464; 425/467

[58] Field of Search ..... 264/29.2, 169, 264/210.8, 211.11, 555; 425/72.2, 198, 464, 467

[56] References Cited

U.S. PATENT DOCUMENTS 4,818,612 4/1989 Hara et al. ..... 264/29.2 X 5,259,947 11/1993 Kalback et al. ..... 208/44

*Primary Examiner*—Leo B. Tentoni

*Attorney, Agent, or Firm*—William D. Hall

[57] ABSTRACT

The present invention provides a blow spinning die particularly suited for spinning solvated pitch into fibers having a random cross-sectional structure. Additionally, the present invention provides a process for blow spinning fibers from solvated pitches. The present invention also provides pitch fibers having a high energy internal molecular structure. Finally, the present invention provides carbon fibers which have a non-radial internal structure.

26 Claims, 3 Drawing Sheets

BLOW SPINNING DIE AND PROCESS FOR SPINNING CARBON FIBERS FROM SOLVATED PITCHES

This is a division of application Ser. No. 08/478,318 filed Jun. 7, 1995, now abandoned.

I. BACKGROUND AND SUMMARY OF THE INVENTION

A. Summary of the Invention

The present invention provides a process and apparatus for blow spinning fibers from solvated pitches. The fibers generated according to the present invention are predominately free of longitudinal and helical cracking.

B. Background of the Invention

The general methods and devices for blow spinning fibers are well known. Typically, a spinnable substance is heated to a temperature which will allow it to flow. This substance then passes, usually under pressure, into a spinning die. A typical die will have a central cavity for receiving the spinnable substance and one or more capillaries or needles. The substance passes through the central cavity into the spinning capillaries and exits as fibers. Upon exiting the capillary, the fiber is contacted with an attenuating media, usually a gas. The attenuating media draws or stretches the fiber increasing its length while decreasing its diameter. Inasmuch as the general methods and devices for blow spinning are well known, further details on this aspect are not necessary. Rather, greater detail is provided in U.S. Pat. Nos. 3,755,527; 4,526,733; and, 4,818,463 which are incorporated herein by reference.

Currently, blow spinning of fibers from carbonaceous pitch is not the predominate practice. However, due to predicted increases in throughput, blow spinning of pitch carbon fibers is expected to yield significant economic advantages over the more common procedure of melt spinning. Further, although blow spinning of carbon fibers has been demonstrated, no technology is known for blow spinning fibers from solvated pitches.

As disclosed by U.S. Pat. No. 5,259,947, incorporated herein by reference, solvated mesophase pitch provides significant advantages over traditional mesophase pitch. However, the unique characteristics of solvated pitches also present novel problems during the spinning of the fibers. Specifically, solvated mesophase pitch has unique physical properties and in particular solvated pitch has rapid solidification times in comparison to nonsolvated pitches. Additionally, under spinning conditions of high throughput and low viscosity, solvated mesophase pitch has very rapid molecular response times. As a result of the rapid molecular response times, solvated pitch has a very short "memory time", i.e. if disrupted or randomized, the pitch molecules or graphitic plates will quickly return to an ordered state.

During the blow spinning of fibers from solvated mesophase pitch, the foregoing characteristics tend to produce fibers having radial cross-sectional structure. For the purposes of this disclosure the cross-section of a fiber is take perpendicular to its axis. These fibers frequently develop longitudinal cracks rendering them undesirable for many applications. In general, these fibers have increased thermal and electrical conductivity and reduced tensile strength, stiffening characteristics and generally poorer overall mechanical quality.

In applications requiring high strength, lower thermal conductivity and good stiffening characteristics, the preferred carbon fibers will have non-radial cross-sectional structure. Production of these fibers requires maintaining the solvated mesophase pitch in a randomized state during the spinning process. Thus, to produce the desired fiber from a solvated pitch, one must overcome the pitch molecules' short memory time or natural tendency to quickly return to an ordered state. In order to produce the desired fibers, the present invention provides novel improvements to the blow spinning die and to the process for blow spinning carbon fibers from solvated pitches.

C. Definitions

For the purposes of this specification and claims, the following terms and definitions apply:

"Pitch" as used herein means substances having the properties of pitches produced as by-products in various industrial production processes such as natural asphalt, petroleum pitches and heavy oil obtained as a by-product in a naphtha cracking industry and pitches of high carbon content obtained from coal.

"Capillary" that portion of a blow spinning slot die which forms a spinnable substance such as a solvated pitch into a fiber. For the purposes of this disclosure the term "capillary" also includes the term "needle" or "spinning needle" as commonly used in annular blow spinning dies and other spinning die types.

"Petroleum pitch" means the residual carbonaceous material obtained from the catalytic and thermal cracking of petroleum distillates or residues.

"Isotropic pitch" means pitch comprising molecules which are not aligned in optically ordered liquid crystal.

"Mesophase pitch" means pitch comprising molecules having aromatic structures which through interaction are associated together to form optically ordered liquid crystals, which are either liquid or solid depending on temperature. Mesophase pitch is also known as anisotropic pitch.

"Solvated pitch" means a pitch which contains between 5 and 40 percent by weight of solvent in the pitch. Solvated pitch has a fluid temperature lower than the melting point of the pitch component when not associated with solvent. Typically, the fluid temperature is lowered by about 40° C. Typical solvated pitches are non-newtonian.

"Fluid temperature" for a solvated pitch is determined to be the temperature at which a viscosity of 6000 poise is registered upon cooling of the solvated pitch at 1°C. per minute from a temperature in excess of its melting point. If the melting point of a solvated pitch could be easily determined, it would always be lower than the fluid temperature.

"Fibers" means lengths of fiber capable of formation into useful articles.

"Pitch fibers" or "pitch carbon fibers" are as spun fibers prior to carbonization or oxidation.

"Carbon fibers" are fibers following carbonization and/or graphitization.

II. BRIEF DISCLOSURE OF THE INVENTION

The present invention provides a blow spinning die especially suited for spinning carbon fibers from solvated pitches. A cross-sectional view of fibers prepared with this die shows a non-radial orientation of the graphitic plates which comprise the fiber. We believe the non-radial alignment of the graphitic plates demonstrates a higher energy internal molecular structure in comparison to fibers having a radial cross-sectional structure.

A typical blow spinning die normally has a central cavity for receiving a spinnable substance. However, the cavity may vary in geometry and in some instances may be eliminated. Additionally, the die will contain at least one capillary which receives the pitch and forms it into a fiber as it passes out of the die. Finally, incorporated into the die is a means for attenuating the spun fiber.

The present invention provides a blow spinning die especially suited for spinning fibers from a solvated pitch. This novel die includes a flow disruption media located within said die. The flow disruption media may be located either within the capillary or more preferably located adjacent to the entrance of the capillary. The disruption media increases and randomizes the path which the pitch must travel prior to final fiber formation. The randomized path imparts disorder to the graphitic plates yielding a fiber having a non-radial cross-sectional structure.

Additionally, the present invention provides an improved process for blow spinning carbon fibers from solvated pitches. The improved process of the present invention produces fibers having a non-radial cross-sectional structure. According to the improved process of the present invention, a spinnable solvated pitch is heated to a temperature sufficient to allow it to flow. The pitch passes into a blow spinning die and exits the die through a capillary as a fiber. Upon exiting the capillary, the fiber is attenuated. The improvement provided by the present invention comprises passing the solvated pitch through a disruption media prior to final fiber formation.

The present invention further provides a pitch fiber which has its internal molecules or graphitic plates arranged in a randomized manner. Following carbonization, the fiber will have a non-radial cross-sectional structure when viewed under a scanning electron microscope. The non-radial cross-sectional structure is believed to indicate the alignment of the internal molecules of the carbon fiber in a high energy state. The carbon fibers provided by the present invention have improved tensile strength, strain to failure ratio, modulus integrity, shear modulus, handleability and lower thermal conductivity.

III. BRIEF DISCLOSURE OF THE DRAWINGS

FIG. 1 depicts a blow spun fiber of the present invention having a non-radial cross-section.

FIG. 2. depicts a blow spun fiber of the prior art having a radial cross-section.

IV. DETAILED DESCRIPTION OF THE INVENTION

A. Blow Spinning Die

Figure 4:
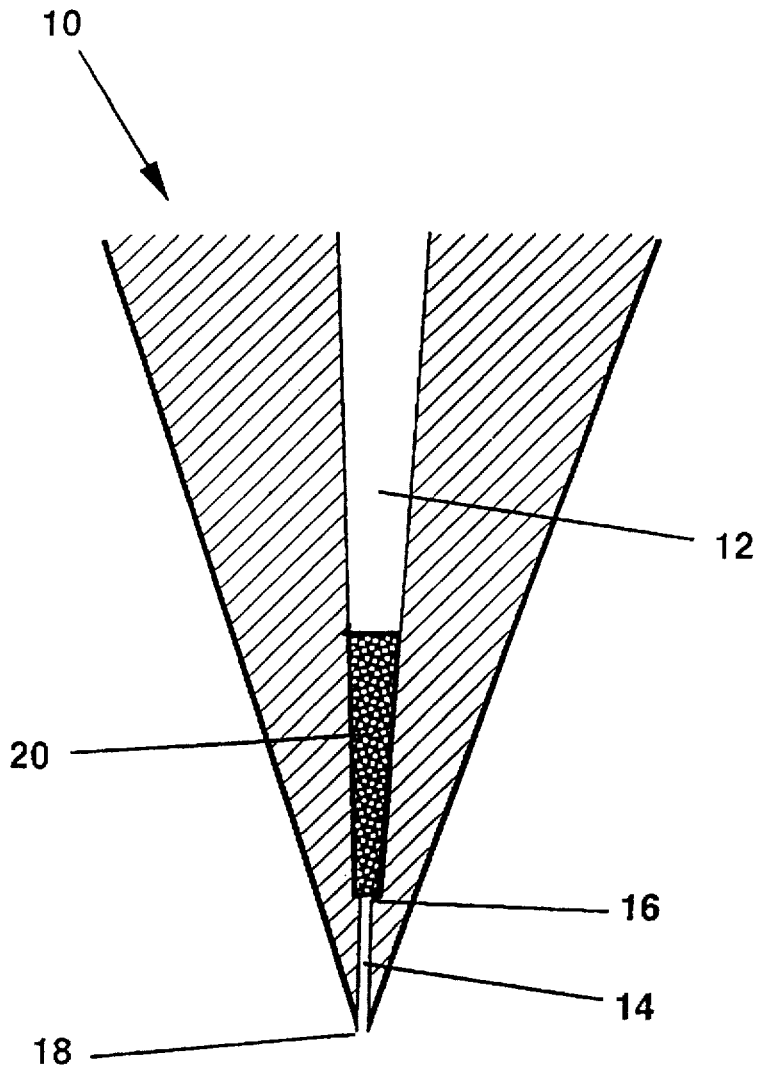
FIG. 4 is a side cut-away view of a blow spinning die showing the location of the disruption media.

With reference to FIG. 4, the present invention provides a blow spinning die for use with solvated pitches. While the current invention will be described in relation to a die tip commonly utilized with a slot die, one skilled in the art will appreciate that the current invention will be equally applicable to annular dies and other fiber spinning dies. FIG. 4 depicts an improved blow spinning die tip 10 according to the current invention. Die tip 10 may include at least one central cavity 12 for receiving the solvated pitch. In fluid communication with cavity 12 is at least one capillary 14 which forms the pitch into a fiber. Capillary 14 has a first opening 16 and a second opening 18. Capillary 14 has a length and diameter suitable for forming solvated pitch into fibers. Die tip 10 additionally incorporates means (not shown) for attenuating the pitch fiber as the fiber exits capillary 14. Finally, according to the present invention, a flow disruption means 20 is positioned within the flow path of the spinnable pitch.

The flow disruption means 20 is preferably a powdered metal such as stainless steel of a standard U.S. mesh size ranging from 60 to 100. However, the composition or design of means 20 is not critical; rather, to be operable, the means 20 must be sufficient to randomize the graphitic plates within the pitch to a degree such that the pitch molecules remain randomized during fiber formation. Thus, a virtually endless number of materials and combination of materials may be used as flow disruption means 20. A non-limiting list may include: mixers, sand, powdered metal, flow inverters, screens, cloth, fibers (including carbon fibers), filtration media and combinations thereof. For example, with certain pitches disruption 20 means may take the form of a combination of a flow inverter and a powdered metal.

Depending upon the size and desired location of disruption means 20, a retaining means (not shown) may be necessary to preclude plugging of the capillary 14 with the disruption means 20. The retaining means may take any form including a piece of wire or cloth.

Typically, flow disruption means 20 operates to increase the path the solvated pitch must travel prior to fiber formation. More importantly, disruption means 20 is of sufficient depth such that it randomizes the orientation of the graphitic plates of the pitch immediately prior to fiber formation. It is believed that the randomization of the pitch by disruption means 20 converts the pitch to a high energy internal molecular structure. Therefore, in the preferred embodiment of the present invention disruption means 20 is located immediately adjacent to capillary 14. In this manner, the pitch will pass directly from disruption means 20 into capillary 14 thereby reducing the opportunity for the pitch molecules to return to an ordered state which in fiber is a radial cross-sectional structure.

Further, in the preferred embodiment the capillary will have a relatively low length to diameter ratio (L/D). In this manner the present invention minimizes the elapsed time between disruption and final fiber formation. Preferably, no time will elapse between randomization of the pitch and its entry into the capillary. Currently an L/D of about 3 is suitable for practice of the present invention; however, an L/D ranging from about 2 to about 10 should be appropriate for practicing the current invention.

In an alternative embodiment, flow disruption means 20 may be located within capillary 14. This embodiment may be particularly appropriate for use in the needles of an annular die. For example, a flow inverter may be located within the needle of an annular die. Thus, the present invention provides an improved blow spinning die 10 particularly suited for spinning fibers from solvated pitches.

B. Process for Blow Spinning Solvated Pitch

With continued reference to FIG. 4, the present invention provides a process for blow spinning pitch carbon fibers. As previously noted, the general techniques of blow spinning are well know and will not be repeated herein. Rather, this disclosure is directed to the problems of blow spinning fibers from a solvated pitch.

In order to blow spin a fiber having the desired physical characteristics from a solvated pitch, the spinning process must retain the internal pitch molecules in a randomized state during fiber formation. As discussed above, solvated pitches when placed under spinning conditions of high throughput and low viscosity, have very rapid molecular response times. As a result, the molecules within the pitch, believed to be in the form of graphitic plates, tend to rapidly return to an ordered state which is believed to be their lowest energy level. Therefore, the process of the present invention provides for retaining the pitch molecules or plates in a randomized state during fiber formation.

Thus, according to the process of the present invention, a spinnable solvated pitch is heated sufficiently to allow the pitch to flow. The pitch passes, usually under pressure, into a die such as die 10. Die 10 as depicted includes a central cavity 12; however, such a configuration is not essential to the present invention. The pitch flows through die 10 and encounters a disruption means 20. As the pitch passes through disruption means 20, the pitch molecules or plates are randomized. In the preferred embodiment, the pitch exits disruption means 20 and immediately enters a spinning capillary 14 which forms the pitch into a fiber. Attenuation of the fiber occurs as it exits the capillary. After attenuation, the fiber is typically carbonized and/or graphitized. If necessary, the fiber may be oxidatively stabilized prior to carbonization.

In the preferred embodiment of the present invention, the proximity of disruption means 20 to capillary 14 is such that fiber formation occurs before the pitch molecules can return to an ordered state which in the case of a fiber is a radial cross-sectional structure. Preferably, disruption means 20 is positioned immediately adjacent to capillary 14 in order to reduce the time between randomization and fiber formation. Thus, as the reduction of time between randomization and fiber formation is important, the present invention also contemplates the desirability of locating disruption means 20 within capillary 14. Finally, the depth of the disruption means 20 may vary depending upon process conditions and the physical properties of the pitch. In general, the primary controlling factor on the depth of disruption media 20 is the need to produce fibers having a non-radial cross-section.

Figure 1:
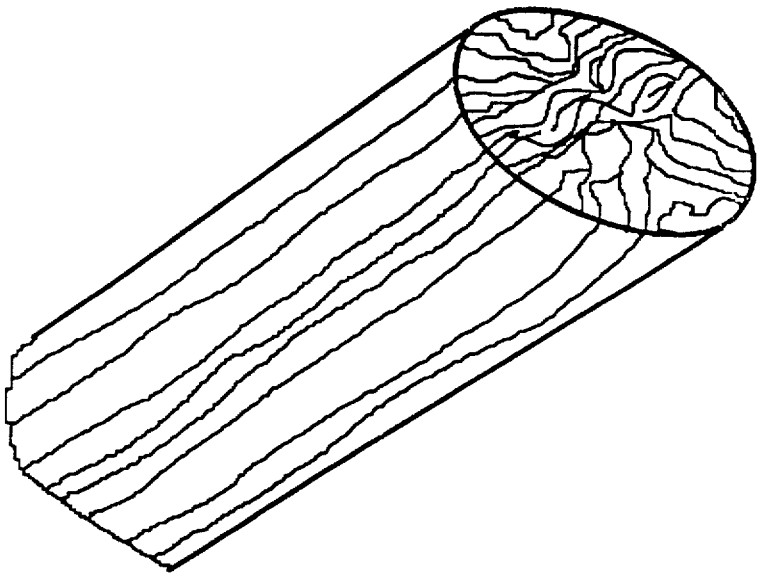
Figure 2:
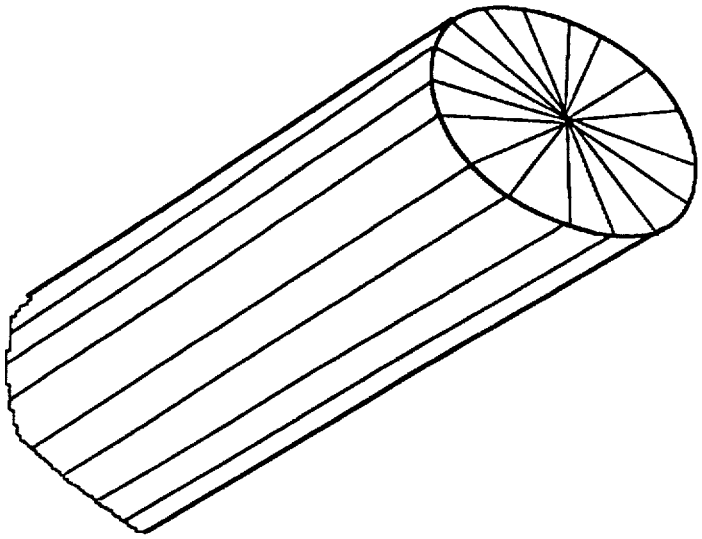
Figure 3:
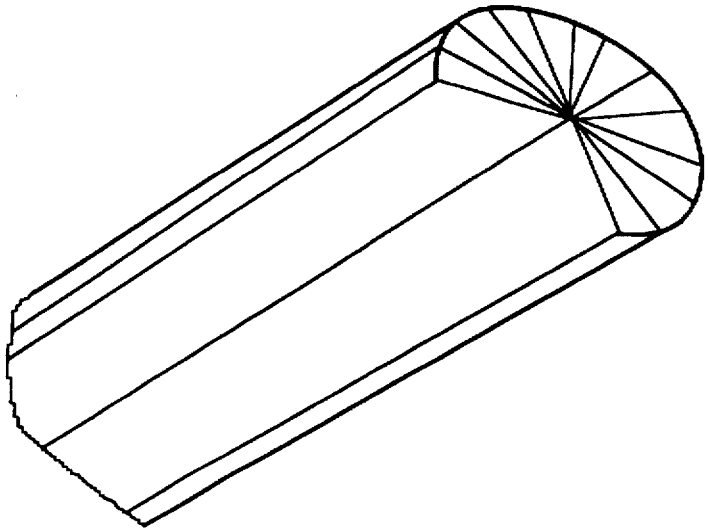
FIG. 3 depicts a blow spun fiber of the prior art having a radial cross-section and showing a longitudinal crack.

Carbon fibers generated according to this process have a non-radial internal structure as depicted in FIG. 1. In contrast, carbon fibers formed according to previous techniques tend to have a radial internal structure as depicted in FIG. 2. Fibers of the type shown in FIG. 2 frequently develop longitudinal cracks as depicted in FIG. 3. Additionally, fibers of this type have been known to develop helical cracks which travel down and around the fiber in the manner of a barber pole or candy cane.

C. Non-radial Carbon Fibers from Solvated Pitch

The present invention provides a novel carbon fiber prepared from solvated pitch. When observed under a scanning electron microscope, the carbon fibers of the present invention show a non-radial cross-sectional structure as depicted in FIG. 1. In contrast prior art fibers have typically shown a radial cross-sectional structure as depicted in FIG. 2. These fibers will frequently develop cracks as depicted in FIG. 3 thereby degrading the fibers usefulness for many applications.

The non-radial cross-sectional structure of the novel fibers is believed to result from a higher energy internal molecular structure during fiber formation than fibers having a radial cross-sectional structure. As a result of the non-radial cross-sectional structure, these novel blow spun fibers have improved physical properties of tensile strength, strain to failure ratio, modulus integrity, shear modulus, handleability and lower thermal conductivity when compared to carbon fibers having a radial cross-section. Preferred fibers will have a 1:1 cross-sectional aspect ratio, i.e. round. However, fibers typically produced by this invention and previous spinning methods are elliptical with cross-sectional aspect ratios ranging from about 1:1.1 to about 1:4 or even greater.

The following table demonstrates the improved tensile strength of fibers having a non-radial cross-sectional structure as compared to fibers which have cracked due to a radial cross-sectional structure.

TABLE 1

| Fiber No. | 1 | 2 | 3 | 4[1] | 5[1] |
|---|---|---|---|---|---|
| Flow Disrupter powdered stainless steel mesh size = 60–80 depth = 0.615 | yes | yes | yes | no | no |
| Pitch Rate g/min/capillary | 0.465 | 0.688 | 0.780 | 0.701 | 0.722 |
| Carbonization Temp. °C. | 1600 | 1600 | 1600 | 1600 | 1600 |
| Modulus 15–25% FSL[2] | 39.2 | 47.6 | 47.6 | 43.9 | N/A |
| tensile strength kpsig | 298 | 366 | 344 | 181 | 138 |

[1]Note: In addition to containing cracks, these fibers were difficult to handle.
[2]Modulus was determined at 15–25% full scale load (FSL) according to ASTM D-3379.

The fibers described in Table 1 were spun on a blow spinning die from a solvated mesophase pitch through a capillary having a L/D of 4 (length=0.015 inches and diameter=0.00375 inches). Fibers 1–3 were prepared according to the process of the current invention and fibers 4–5 were prepared without the use of a flow disruption means. In general, fibers 1–3 were free of cracks and had cross-sectional structures similar to that depicted by FIG. 1. Fibers 4–5 contained cracks and had radial cross-sections similar to FIGS. 2 and 3. Due to the presence of cracks and bends, fibers 4–5 had significantly lower tensile strength values than fibers 1–3.

Other embodiments of the present invention will be apparent to those skilled in the art from a consideration of this specification or practice of the invention disclosed herein. It is intended that the specification be considered as only exemplary, with the true scope and spirit of the invention being indicated by the following claims.

We claim:

1. In a blow spinning die comprising, at least one capillary for forming a fiber said capillary having a first open end and a second open end wherein the improvement comprises:

flow disruption means positioned within said die; and, said capillary has a length to diameter (L/D) ratio ranging from about 2 to about 10.

2. The blow spinning die of claim 1, wherein said disruption means is located within said capillary.

3. The blow spinning die of claim 1, wherein said disruption means is located immediately adjacent to said first open end of said capillary.

4. The blow spinning die of claim 1, wherein said disruption means is selected from the group of mixers, sand, powdered metal, flow inverters, screens, cloth, fibers, filtration media and combinations thereof.

5. The blow spinning die of claim 1, wherein said disruption means is powdered metal.

6. The blow spinning die of claim 1, wherein said die is a slot die or an annular die.

7. The blow spinning die of claim 1, wherein said capillary has a L/D ratio of about 3.

8. In a solvated pitch blow spinning die comprising at least one capillary for forming a fiber, said capillary having a first open end and a second open end wherein the improvement comprises:

flow disruption means located within said die; and, said capillary has a length to diameter (L/D) ratio ranging from about 2 to about 10.

9. The blow spinning die of claim 8, wherein said disruption means is located within said capillary.

10. The blow spinning die of claim 8, wherein said disruption means is located immediately adjacent to said first opening of said capillary.

11. The blow spinning die of claim 8, wherein said disruption means is selected from the group of mixers, sand, powdered metal, flow inverters, screens, cloth, fibers, filtration media and combinations thereof.

12. The blow spinning die of claim 8, wherein said disruption means is powdered metal.

13. The blow spinning die of claim 8, wherein said die is a slot die or an annular die.

14. The blow spinning die of claim 8, wherein said capillary has a length to diameter ratio of about 3.

15. A process for blow spinning fibers comprising:

heating a spinnable pitch to a temperature sufficient to allow the pitch to flow;

passing the pitch into a blow spinning die, said die having at least one capillary;

passing said pitch through said capillary to form a fiber; and, while passing said pitch through said capillary, passing said pitch through a disruption means.

16. The process of claim 15, wherein said pitch exits said disruption means and immediately enters said capillary.

17. The process of claim 15, wherein said spinnable pitch is a solvated pitch.

18. The process of claim 15, wherein said spinnable pitch is a solvated mesophase pitch.

19. The process of claim 15, wherein said disruption means is selected from the group of mixers, sand, powdered metal, flow inverters, screens, cloth, fibers, filtration media and combinations thereof.

20. The process of claim 15, wherein said disruption means is powdered metal.

21. The process of claim 15, additionally comprising the step of carbonizing said fiber.

22. In a process for blow spinning fibers comprising, heating a solvated pitch to a temperature sufficient to allow the pitch to flow, passing the pitch into a blow spinning die, said die having at least one capillary, passing said pitch through said capillary to form a fiber, wherein the improvement comprises:

passing said pitch through a disruption means located within said capillary.

23. The process of claim 22, wherein said pitch exits said disruption means and immediately enters said capillary.

24. The process of claim 22, wherein said solvated pitch is a solvated mesophase pitch.

25. The process of claim 22, wherein said disruption means is selected from the group of mixers, sand, powdered metal, flow inverters, screens, cloth, fibers, filtration means and combinations thereof.

26. The process of claim 22, wherein said disruption means is powdered metal.

* * * * *